United States Patent [19]

Hamilton

[11] Patent Number: 4,864,674

[45] Date of Patent: Sep. 12, 1989

[54] ROTARY BROOM

[76] Inventor: Nathaniel Hamilton, 4434 Mt. Elliott, Detroit, Mich. 48207

[21] Appl. No.: 108,808

[22] Filed: Oct. 14, 1987

[51] Int. Cl.[4] ..... A47L 11/22

[52] U.S. Cl. ..... 15/4; 15/1; 15/41 R; 15/49 C; 15/79 R; 15/98; 15/105

[58] Field of Search ..... 15/1, 3, 4, 41 A, 41 R, 15/49 C, 79 A, 79 R, 83, 98, 105; 56/328 R

[56] References Cited

U.S. PATENT DOCUMENTS

| | | | |
|---|---|---|---|
| 699,699 | 5/1902 | Newberry | 222/369 |
| 2,433,478 | 12/1947 | Nelson | 222/369 |
| 3,774,257 | 11/1973 | Smyth | 15/48 |
| 3,859,683 | 1/1975 | Coult | 15/79 R |
| 3,959,922 | 6/1976 | Leistikow | 15/79 R |
| 4,091,968 | 5/1978 | McNaull | 222/369 |
| 4,552,460 | 11/1985 | Wallace | 222/369 |
| 4,643,294 | 2/1987 | Whited | 198/498 |

*Primary Examiner*—Edward L. Roberts

[57] ABSTRACT

A device which has wheels is provided that has a removable disc with blades such that when the disc is placed in a certain position the device acts as a pushbroom, and when the disc is continously rotated, the device can act as a dustpan as well as a dustmop.

15 Claims, 5 Drawing Sheets

ROTARY BROOM

BACKGROUND OF THE INVENTION

Brooms, more or less, have some inconveniences. For instance, they do not have built-in dustpans. In order to sweep up refuse particles using a broom one ordinary has to use a dustpan. This requires the use of two devices and requires the user to bend over. Brooms that have straws are also not designed specifically to work as dustmops. Moreover, when straw brooms become old it is customary for the straws to fall out or become so worn that they loose their ability to work. In most cases, when this happens a whole new broom, entire frame with straws, has to be purchased.

OBJECTS OF THE INVENTION

It is the object of this invention to provide a preferred embodiment which has the following:

1. A removable disc with blades such that when the disc is placed in a certain position the device acts as a pushbroom, and when the disc is continuously rotated, and device can act as a dustpan as well as a dustmop.
2. A container for holding refuse particles until they can be discarded.
3. Special lock mechanisms embedded in a wheel that turns the disc and in the refuse container which enables the device to accomplish the things outlined in 1.
4. A small auxiliary brush used for sweeping corners and under objects.
5. One handle for use with device and with auxiliary brush.

The preferred embodiment will be called the Rotary Broom.

DESCRIPTION OF PREFERRED EMBODIMENT

Figure 1:
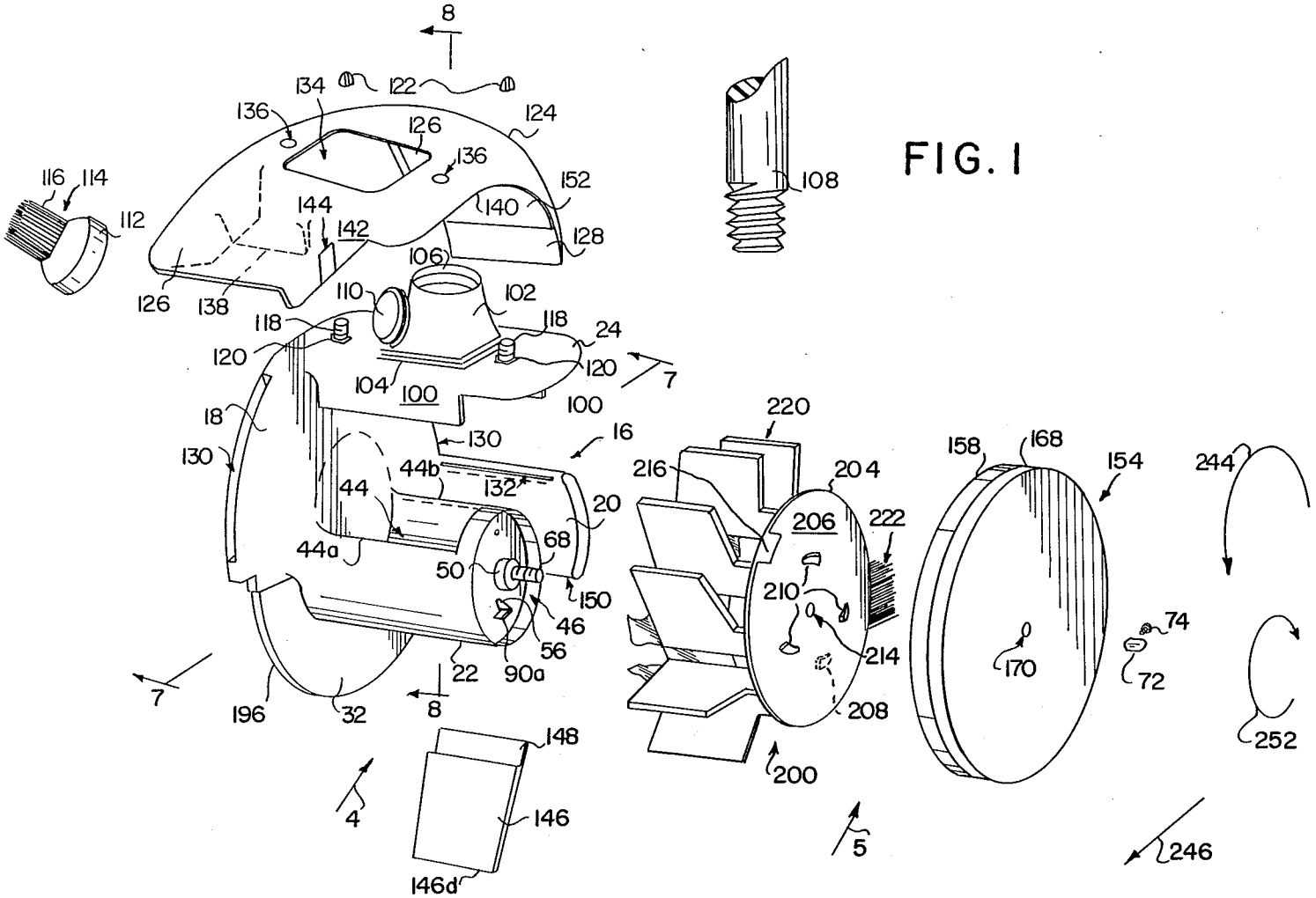
FIG. 1 is an exploded view of the Rotary Broom showing how some of its parts are connected.

In FIG. 1, 16 denotes the frame of the Rotary Broom. It is made up of curvilinear flat piece 18, extended member 20, cylinder 22, and support bar 24.

Figure 7:
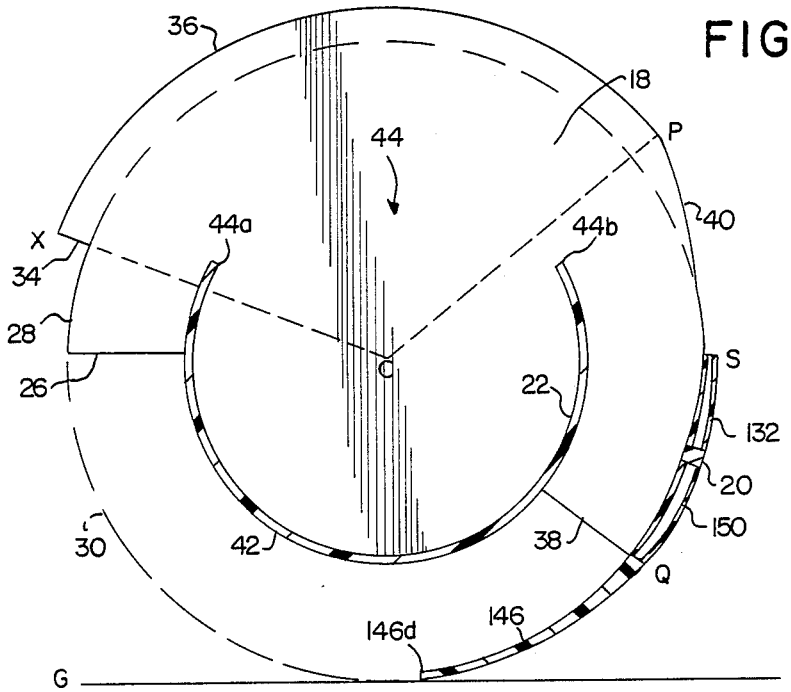
FIG. 7 is a sectional side view of the Rotary Broom with support bar removed taken at line 7—7 of FIG. 1.

The base of the frame is piece 18. All the edges of this piece are shaped differently. In FIG. 7, front tip edge 26 is generally parallel to ground level G. Front outer edge 28 is an arc of circle 30. Circle 30 has center C. Circle 30 is also the periphery of wheel 32 (FIG. 1). Clockwise from edge 26, piece 18 becomes extended, forming circular edge 36. Edge 36 is an arc of a larger circle concentric to circle C. Connecting edges 28 and 36 is edge

34. Edge 36 ends at point P. Situated at a large counterclockwise angle from edge 26 are back tip edge 38 and extended member 20. Member 20, also shown in FIG. 1, is a circular part that extends from piece 18. Member 20 runs along arc QS of circle 30. Tangent to points P and S is edge 40 of piece 18. Inbetween the counterclockwise angle formed by edges 26 and 38 is edge 42. Edge 42 is formed from cylinder 22 (FIGS. 1&7).

Figure 4:
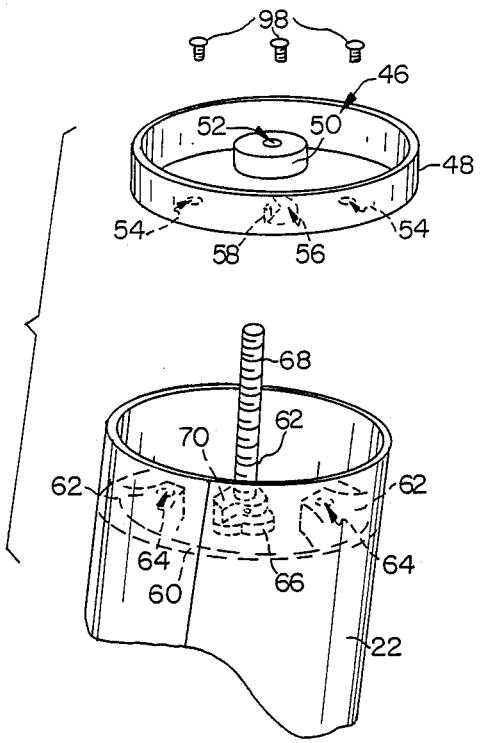
FIG. 4 is an exploded view of the end of the refuse container (a cylinder) taken in the direction of arrow 4 in FIG. 1.

Cylinder 22 extends from piece 18; this is shown in FIG. 1. FIG. 1 also shows that this cylinder has opening 44 in its lateral side. This opening is positioned so that ends 44*a* 44*b* in FIGS. 1 and 7 are positioned a few degrees clockwise from lines XC and PC in FIG. 7, respectively. As shown in FIG. 4, inside of cylinder 22 close to its end and fixed to its lateral side is base 60. Ribs 62 with holes 64 in their tops extend up from base 60. Lock mechanism 66 (see below) is also on base 60. Base 60 has a hole in the middle so that bolt 68 can pass through it. Nut 70 secures bolt 68 to base 60. Cap 72 with locking screw 74 fit on bolt 68 (FIG. 1).

At the end of cylinder 22 is cavity 46 (FIG. 1). The cavity, shown more better in FIG. 4, is formed from hollow plate 48. Inside of this plate is circular core element 50 with hole 52 in its center. The core element is hollow underneath. Holes 54 are equally spaced from one another in the bottom of plate 48. Aperture 56 with adjacent pin 58 are situated on one side of plate 48.

Figure 2:
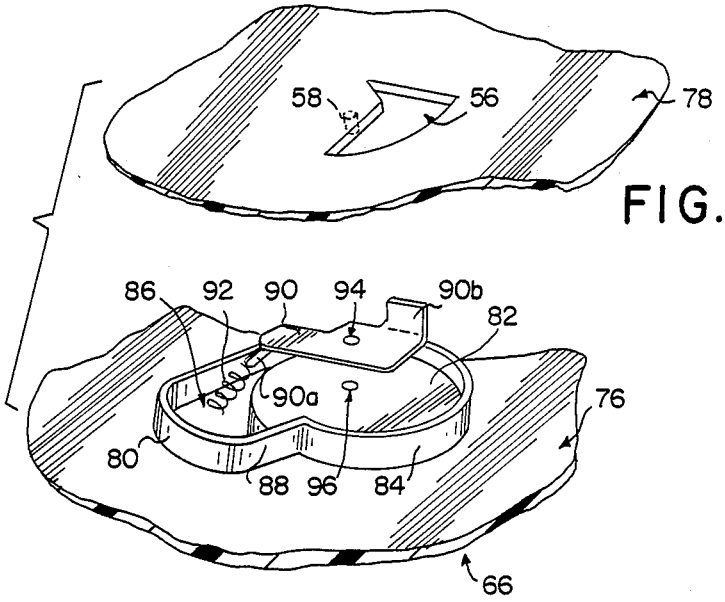
FIG. 2 is an exploded view of the lock mechanism.
Figure 3:
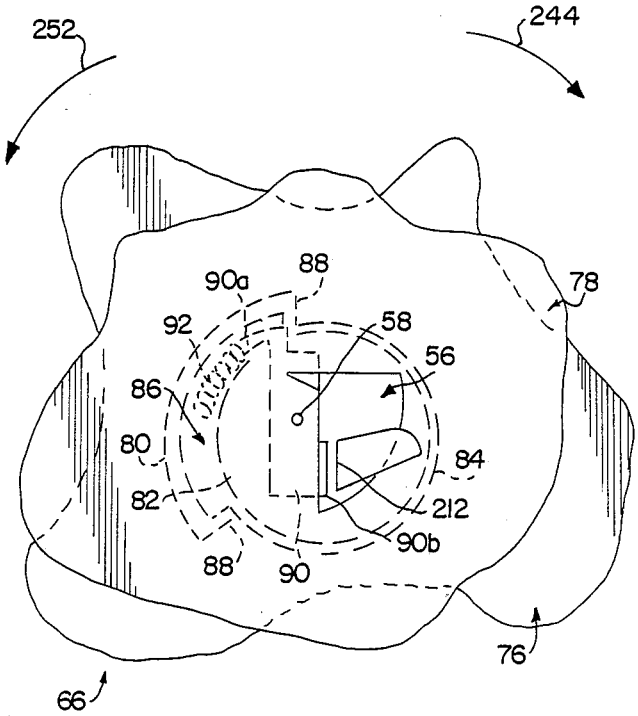
FIG. 3 is a plan view of the lock mechanism with an enlarged view of a boss.

Two detailed drawings of the lock mechanism are shown in FIGS. 2 and 3: 66 denotes the entire lock mechanism, 76 denotes either the cutaway base of cylinder 22 or that of wheel 154 (see below), 78 denotes either the cutaway cavity plate of cylinder 22 or that of wheel 154. Plate 78 has aperture 56 with adjacent pin 58. Passage wall 80, pedestal 82, and supporting wall 84 extends from base 76. Inbetween walls 80 and pedestal 82 is circular passage 86 with closed ends 88.

When the lock mechanism is assembled (FIGS. 2&3), spinning member 90 lies on top of pedestal 82 with protrudent end 90*a* inside of passage 86. Compression spring 92 lies in passage 86 with end 90*a* fitted into one end of the spring. Cavity plate 78 rests on top of walls 80 and 84 with pin 58 place through spinning member hole 94 and into pedestal hole 96. Bent up end 90*b* extends through opening 56. Plate 78 does not touch member 90 because walls 80 and 84 are just high enough in height to let member 90 move freely.

When the cavity section of cylinder 22 is assembled (FIG. 4), bolt 68 passes through hole 52, core 50 lies over nut 70, pin 58 passes through holes 94 and 96 of lock mechanism 66 (FIG. 2), end 90*b* passes through aperture 56, and plate 48 rests on ribs 62 such that holes 54 and 64 coincide. Ribs 62 are the same height as lock mechanism walls 80 and 84. Screws 98 are placed in ribs 62 through holes 54 and 64.

Support bar 24, shown in FIG. 1, extends from piece 18 in the same direction as that of cylinder 22. The bar is a body that has thin flat pieces 100 extending downward in the front and back of it. Pieces 100 are positioned so that they are directly over opening 44. Extending from the top of the bar is socket and shaft attachment 102. The attachment has bottom 104. Socket 106 of the attachment is female threaded so that male threaded handle 108 can fit in it. Shaft 110 of the attachment is male threaded so that female threaded end 112 of auxiliary brush 114 can fit on it. End 112 is able to fit on handle 108. Auxiliary brush 114 has supple straws 116. On the top of bar 24 are bolts 118. They extend upward from bar 24 and are fastened to it by embedded nuts 120. Threaded caps 122 fit on bolts 118.

Lid 124 is shown in FIG. 1. It is shaped so that its body exactly surrounds edges 36 and 40 of piece 18 (FIG. 7). Flanges 126 extends from one side of the lid and flange 128 extends from the back of the lid. Embedded in piece 18 are slots 130. Flanges 126 fit into slots 130. Member 20 has slot 132 embedded in it near its top. Flange 128 fits into slot 132. On the top of lid 124 are orifice 134 and holes 136. They are positioned and shaped such that they fit over bottom 104 and bolts 118, respectively. Thin flat piece 138, similar to pieces 100, extends from the inside of the lid in front of orifice 134. Rim 140 of lid 124 extends down just far enough to slide over lateral side 158 of wheel 154. Front part 142 of rim 140 is indented inward and has mark 144 on it.

Piece 146 (FIG. 1) is a smooth shovellike part that is a continuation of frame 16. In the bottom of member 20 is embedded slot 150. End 148 of piece 146 is able to fit tightly into this slot. Piece 146 and back of lid 152 are made so that when they are connected to extended member 20 there is one smooth path along the surfaces and edges connecting them. Piece 146 has tip **146*d***.

Figure 5:
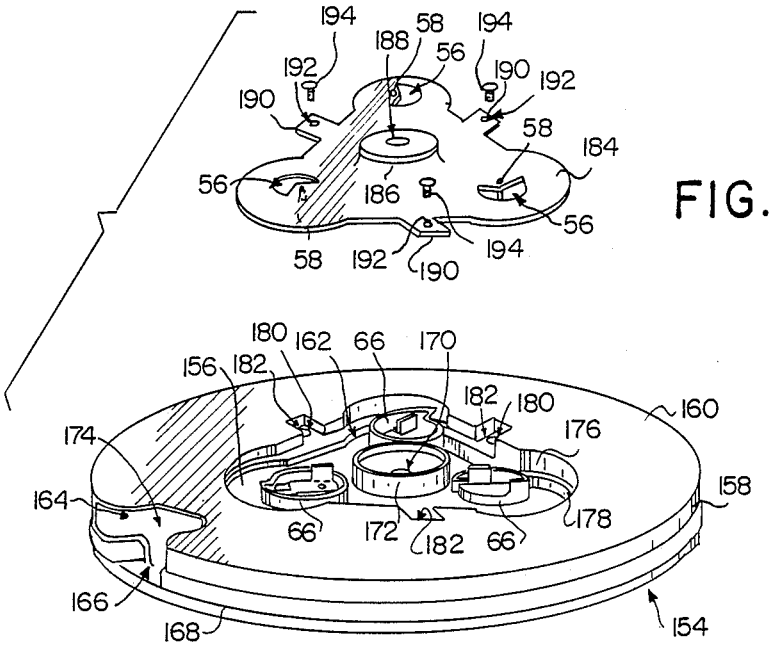
FIG. 5 is an exploded view of the driving wheel taken in the direction of arrow 5 in FIG. 1.

Wheel 154 or the driving wheel is essentially a flat, hollow cylinder (FIGS. 1&5). It is made up, in part, of base 156, lateral side 158, face 160, and cavity 162. These are shown in FIG. 5 along with partially cutaway section 164 of wheel 154. Lateral side 158 has encirling groove 166. Tire 168 is mounted in this groove. In the center of base 156 is hole 170. Small cylinder 172, which extends from base 156, surrounds hole 170. Equally spaced around cylinder 172 are lock mechanisms 66. They extend from base 156. Cavity 162 has surrounding wall 176 that extend from base 156 to face 160. The bottom of wall 176 is shaped so that it forms narrow ledge 178. The height of this ledge is the same as that of walls 80 and 84 of lock mechanism 66. In some places along ledge 178 are holes 180 with surrounding cutouts 182. Holes 180 are equally spaced from one another. The empty space inbetween side 158 and wall 176, inside of wheel 154, is denoted by 174.

Plate 184 of wheel 154 is a flat surface that has the same shape as cavity 162 (FIG. 5). Extending from the center of the plate is core element 186. Element 186 is shaped so that it can fit over small cylinder 172. Hole 188 is in the center of element 186. Apertures 56 with adjacent pins 58 are positioned on plate 184 so that they coincide, in position, with lock mechanisms 66 in base 156. Tabs 190 with holes 192 are placed on the end of plate 184 so that they coincide with cutouts 182 and holes 180, respectively.

When wheel 154 is assembled (FIG. 5), plate 184 rests on ledge 178. Also analogous to plate 48 and to those parts which are located on base 60 of cylinder 22 (FIG. 4), all parts on plate 184 fit on or in those of cavity 162. Screws 194 fit through holes 192 and 180.

Figure 8:
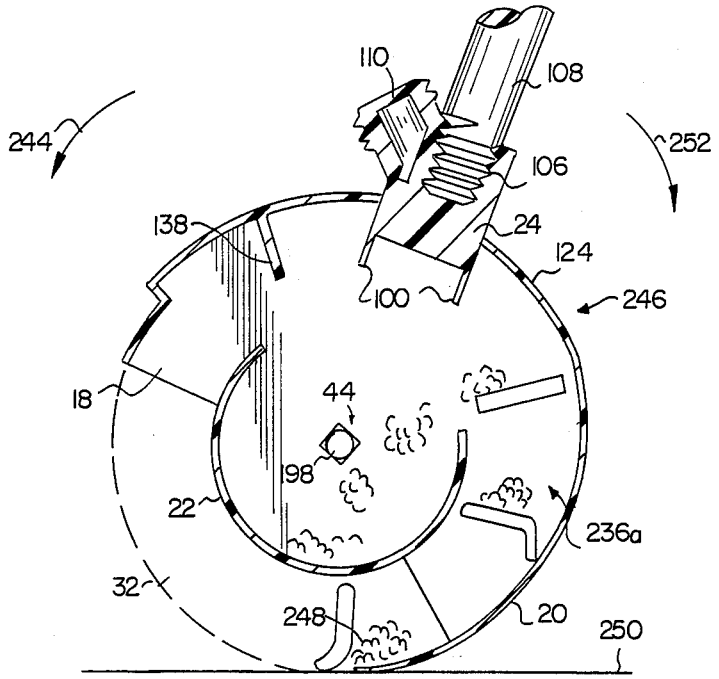
FIG. 8 is a sectional side view of the Rotary Broom when it is in its pick-up mode taken at line 8—8 of FIG. 1.
Figure 9:
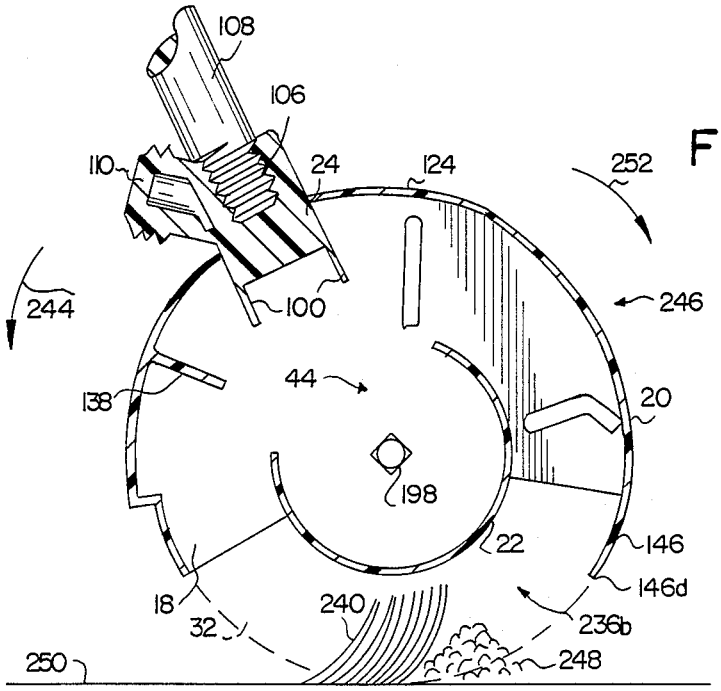
FIG. 9 is a sectional side view of the Rotary Broom when it is in its push mode taken at line 8—8 of FIG. 1.

In FIG. 1, wheel 32 has tire 196. This wheel is attached to frame 16 with bolt 198 that runs through wheel 32 and through piece 18. A nut secures bolt 198 to piece 18, and wheel 32 has conventional bearings (e.g. roller, ball) to allow it to turn around bolt 198, (FIGS. 8 &9).

Figure 6:
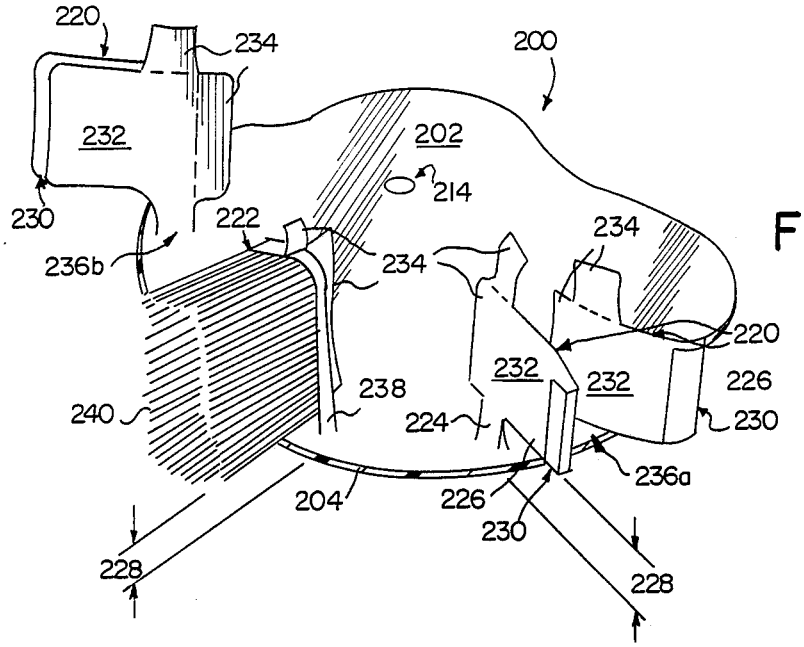
FIG. 6 shows a cutaway portion of the blade disc near the straw blade end.

Blades disc 200 is a round flat body with bosses and blades. It is shown in FIGS. 1 and 6. Surface 202 of flat body 204 is the surface facing cylinder 22, and surface 206 is the surface facing wheel 154. Boss 208 extends from surface 202. Bosses 210, which are equally spaced from one another, extend from surface 206. All bosses (208 and 210) are positioned on the blade disc such that their ends 212 are able to adjoin with ends **90*b* of lock mechanisms 66. In other words, boss 208 is able to come together with end 90*b* of the lock mechanism of cylinder 22, and bosses 210 are able to come together with ends 90*b* of the lock mechanisms of wheel 154. FIG. 3 shows how a boss would come together with end 90*b* of a lock mechanism. In the center of flat body 204 is hole 214. Rider 216 extends from the edge of body 204**.

All blades on disc 200 extend from surface 202 as shown in FIGS. 1 and 6. They are situated on surface 202 in such a way that they form a circular mosaic near the edge of body 204. All blades are alike except for one. Blades 220 are the blades that are all alike. Blade 222 is the different blade.

Each one of blades 220 is made up of a rigid part 224 and flexible part 226. As shown in FIG. 6, part 224 is the part that extends from surface 202. Part 226 is a piece of spongy, slightly bristly material such as polyurethane foam. Part 226 is attached to part 224 at distance 228 above surface 202. Except for portion 230, all areas of blades 220 are covered with a very smooth, thin elastic material 232 such as polyvinylchloride. Streamers 234 are on the edges of blades 220 as shown in FIGS. 1 and 6. The space inbetween blades 220 is denoted by **236*a***.

Blade 222 is a blade made up of end 238 with flexible straws 240 extending from it. End 238 extends from surface 202 and can be situated as shown in FIG. 6. Like the flexible part of blades 220, straws 240 are at a distance 228 above surface 202. Streamers 234 are on the edges of blade 222 as shown in FIG. 6. The larger space inbetween blade 222 and one of the surrounding blades 220 is denoted by **236*b* (FIG. 6**).

OPERATION OF PREFERRED EMBODIMENT

The Rotary Broom is assembled for use, as shown in FIG. 1, by doing the following: placing piece 146 in member 20, putting blade disc 200 in frame 16, putting wheel 154 on top of disc 200 (rider 216 rests on side 158), locking cap 72 on bolt 68 with screw 74, placing lid 124 on frame 16, putting handle 108 in socket 106, and placing auxiliary brush 114 on shaft 110.

The Rotary Broom has two modes. One mode is the push mode; the other is the pick-up mode. Lock mechanisms 66 (FIGS. 2&3) play an important role in the operation of the two modes. The lock mechanisms are the components which allow many of the parts of the broom to interact and work together.

The lock mechanisms perform their function via way of their structure. One part of the lock mechanism, namely spinning member 90, has more freedom of movement in one direction than in another direction. Spinning member 90, shown in FIGS. 2 and 3, is able to rotate about cavity pin 58. When the lock mechanism is operating, member 90 turns within the narrow space between pedestal 82 and plate 78. Because they are both parts which make up member 90, everytime end **90*b* is rotated either clockwise or counterclockwise, end 90*a* is rotated clockwise or counterclockwise, respectively. As is evident in FIGS. 2 and 3, once member 90*b* has been turned counterclockwise to a certain extent, it is prevented from being turned any further by and edge of aperture 56. This is the edge which is situated horizontally in FIG. 3. Likewise, member 90*b* is prevented from being turned any further clockwise—once it has been turned to a certain extent—by another edge of aperture 56. This is the edge which is situated vertically in FIG. 3. Like the horizontal and vertical edges of aperture 56, ends 88 prevent end 90b** from turning any further counterclockwise and clockwise too (FIGS. 2&3).

When end 90a moves counterclockwise, it moves through passage 86 while pushing encompassing spring 92 along with it. This is evident in FIG. 3. As end 90b moves further away from the vertical edge of aperture 56, there comes a point where spring 92 comes in contact with end 88 at the bottom of the lock mechanism, and the spring begins to compress in passage 86. As end 90b is pushed even further from the vertical edge, spring 92 continues to compress, and it does so until the tension in it enables it to propel end 90a back through passage 86 and up to end 88 at the top of the lock mechanism where end 90a comes to rest (FIG. 3). Meanwhile, end 90b is brought back to the vertical edge of aperture 56 where it rests also.

When the Rotary Broom is operating, bosses 208 and 210 slide over plate 78 (FIGS. 2&3): bosses 210 slide over plate 184 (FIGS. 1&5), and boss 208 slides over plate 48 (FIGS. 1&4). The lock mechanisms in conjunction with the bosses in the broom can work in either of two ways; the lock mechanisms may operate elastically or they may operate in the lock manner. When a lock mechanism operates elastically, a boss as it is sliding over plate 78 collides with end 90b, pushes end 90b aside and then move on (see FIGS. 2&3). After the boss has moved from the vicinity of aperture 56, end 90b is returned to its resting place on the vertical edge of the aperture by spring 92, as discussed above. The path that the boss take when the lock mechanism is operating elastically is indicated by arrow 244 in FIG. 3. First the boss passes over the vertical edge of aperture 56; then it crosses the curve edge of the aperture. If a boss were to move in the direction of arrow 252 over plate 78 in FIG. 3, end 212 of the boss would collide with end 90b. In this instance, unlike when the lock mechanism is operating elastically, end 90b would not be pushed aside but would be pushed against the vertical edge of aperture 56 by the motion of the boss instead. Consequently, the boss would be stopped from moving if the lock mechanism is at rest or forced to move in the direction of arrow 244 (FIG. 3) if the lock mechanism, itself, moves in that direction. When a lock mechanism operates in this way, it operates in the lock manner.

The direction that a boss takes as it moves pass end 90b is important because it is the direction in which the boss is moving in that determines whether the lock mechanism operates elastically or whether it operates in the lock manner.

It is not necessary for aperture 56 to have the shape that it has in FIGS. 2 and 3; any other aperture which is shaped differently but which functions like aperture 56 would suffice. The function of the vertical edge is to stop end 90b from turning after a boss has collided with it when the boss moves in the direction of arrow 252 in FIG. 3 (i.e. when the lock mechanism is operating in the lock manner).

It is not even necessary for the boss to have the shape that it has in FIG. 3. What is important is that the boss used be small enough to slide circularly around elements 50 and 186 on plates 48 and 184, respectively, and that the boss have the ability to move within cavities 46 and 162 (FIGS. 1,4,&5). The boss should also have one end which has a shape capable of pushing end 90b aside easily when moving over plate 78 and one end which has the capability of coinciding with end 90b. The boss shown in FIG. 3 has such a shape.

The direction in which the Rotary Broom is pushed is important in that it determines how each lock mechanism in the broom operate (i.e. whether one operates elastically or in the lock manner). If the Rotary Broom is pushed in the direction of arrow 246 (FIGS. 1&8) then the lock mechanisms in the driving wheel operate in the lock manner while the lock mechanism in cylinder 22 operates elastically. However, if the Rotary Broom is pushed in the direction opposite to that of arrow 246, the lock mechanisms in the driving wheel operate elastically while the lock mechanism in cylinder 22 operates in the lock manner.

Pushing the Rotary Broom in the direction of arrow 246 causes the driving wheel to turn in the direction shown by arrow 244 (FIGS. 1&8). The lock mechanisms in the driving wheel—and hence ends 90b within them—trace a circular path around bolt 68 (FIG. 1). If ends 90b of the lock mechanisms in the driving wheel do not come in contact with bosses 210 when the wheel starts to turn, they will after the wheel continues to turn. This is because ends 90b of the lock mechanisms in the driving wheel always collide with bosses 210. This occurs regardless of the direction in which the driving wheel is turning. If the driving wheel is rotated in the direction of arrow 244, however, ends 90b of the lock mechanisms in the wheel adjoin with ends 212 of bosses 210 (the lock mechanisms in the driving wheel are set to operate in the lock manner). Consequently, bosses 210 move with ends 90b, and blade disc 200 turns with the driving wheel. When disc 200 turns along with the driving wheel, the motion of each of the lock mechanisms in the driving wheel (and of bosses 210) is like that of the lock mechanism and boss in FIG. 3 when both components in the figure move in the direction of arrow 244. The lock mechanism in the figure can be thought of as pushing the boss in the direction of arrow 244.

Rotation of blade disc 200 in the direction of arrow 244 causes boss 208 to move circularly around core 50 inside of cavity 46. As disc 200 moves in the direction of arrow 244, the lock mechanism in cylinder 22 operates elastically: everytime boss 208 passes end 90b in cylinder 22, the boss pushes end 90b aside and moves on. The motion of boss 208 is like that of the boss in FIG. 3 if it were to move in the direction of arrow 244 over plate 78. It is possible for disc 200 to turn freely when the Rotary Broom is pushed in the direction of arrow 246 because the lock mechanism in cylinder 22 operates elastically when the broom is pushed in that direction.

If the Rotary Broom is pushed in the direction opposite to arrow 246, blade disc 200 no longer turns with the driving wheel. Ends 90b of the lock mechanisms in the driving wheel no longer adjoin with ends 212 of bosses 210; instead, ends 90b are pushed aside by bosses 210 as the driving wheel turns in the direction of arrow 252 (i.e. the lock mechanisms in the driving wheel no longer operate in the lock manner but operate elastically). The lock mechanism in cylinder 22, however, is capable of operating in the lock manner, and if the user of the Rotary Broom were to adjust disc 200 properly, as will be discussed below, the lock mechanism could, in fact, operate in the lock manner.

To use the Rotary Broom in the push mode, first rider 216 has to be lined with lid mark 144. This is done by the user of the broom—who sees the rider and lit mark from a standing position—by tilting handle 108 in the direction of arrow 252 and pushing the broom in the direction of arrow 246 (FIGS. 1&8). It is possible to line rider 216 with mark 144 because the rider is a part of disc 200, and when the Rotary Broom is pushed in the direction of arrow 246, disc 200 turns.

After rider 216 has been lined with mark 144, all that remains to be done to use the Rotary Broom in the push mode is to tilt handle 108 in the direction of arrow 244 and push. FIG. 9 shows how this is done. This figure also shows the Rotary Broom pushing refuse particles 248 across surface 250.

The rider is lined with the lid mark before using the push mode because after this is done and when handle 108 is tilted in the direction of arrow 244, blade 222 is made horizontal to surface 250 (FIG. 9). Moreover, by lining the rider with the lid mark, the lock mechanism in cylinder 22 is set to operate in the lock manner. End 212 of boss 208 is adjoined with end **90*b* of the lock mechanism in cylinder 22; this stops boss 208 from moving in the direction of arrow 252 and, in turn, stops disc 200 from turning in the direction of arrow 252 (FIGS. 1&9). Rider 216, blade 222 and boss 208 are all positioned on disc 200—and mark 144 on lid 124—in such a way that they cause these effects. In other words, (1) blade 222 is so positioned on disc 200 such that when rider 216 is lined with mark 144, blade 222 is moved close to line XC (FIG. 7), thus causing blade 222 to align horizontally to surface 250 when handle 108 is tilted in the direction of arrow 244 (FIG. 9); (2) boss 208 is so position on disc 200 such that when blade 222 is positioned close to line XC, end 212 of boss 208 adjoins with end 90*b* of the lock mechanism in cylinder 22, thus preventing disc 200 from turning in the direction of arrow 252; (3) rider 216 and mark 144 are so positioned on disc 200 and on lid 124**, respectively, so as to indicate to the user that (1) and (2) are occurring when the rider and lid mark meet.

When the Rotary Broom is in the push mode, the driving wheel, unlike the blade disc, is free to turn in the direction of arrow 252 (FIGS. 1&9). The driving wheel is able to turn in this direction because all the lock mechanisms in the wheel operate elastically.

The Rotary Broom in the push mode performs like an ordinary push broom. To use the Rotary Broom in the pick-up mode all that need to be done is to tilt handle 108 in the direction of arrow 252 and push. By pushing the Rotary Broom in the direction of arrow 246 (FIGS. 1&8), the driving wheel turns blade disc 200 as discussed above. As a consequence, any refuse particles 248 located at tip **146*d* become pushed up piece 146, through frame 16, and gravitationally deposited into cylinder 22. This is shown in FIG. 8. Cylinder 22** acts as the refuse container of the Rotary Broom.

During the depositing process, when blades 220 approach tip **146*d* of piece 146, uncovered portions 230 lie flat on surface 250 (FIG. 8). As blades 220 move upward, uncovered portions 230 begin to bend downward, and refuse particles 248 are trapped beneath them. Blades 220 remain bent until they line up with segment CP (FIG. 7). The blades then straighten up, and any refuse particles should begin to fall, if they have not already fallen, through spaces 236*a* and into cylinder 22 (the refuse container). Light particles such as dust that do not fall into cylinder 22 right away are removed from blades 220 by flat pieces 100 and 138 (FIGS. 1&8**).

The Rotary Broom in the pick-up mode can be used as a dustmop on smooth or semi-smooth surfaces. When it is necessary to empty cylinder 22, lid 124 can be removed and the Rotary Broom turned upside down.

To sweep around sharp corners handle 108 and auxiliary brush 114 may be removed from attachment 102 and placed together.

Worn out or damaged blade discs can be replaced by removing and putting back the driving wheel. Inoperable springs can also be replaced by removing and putting back cavity plates.

Although one embodiment (the Rotary Broom) is described in detail above, the invention, a more general device which the embodiment falls under, has many variations. In other words, the preferred embodiment described above is but one form of the invention which is covered in the claims.

I claim:

1. A device which can move across surfaces and pick-up objects comprising:

a frame having a shovellike part, a rotating element with means of pushing or scooping up objects, said means being comprised of individual members which are spatially separated from one another on said rotating element, a receptacle attached to the frame, said receptacle having an opening so positioned in the frame such that when the rotating element turns, the spaces between said members on said rotating element continually meet with the opening, forming a passageway through the spaces between said members on said rotating element, pass the opening in the receptacle, and into said receptacle means to move the frame across surfaces, means to drive the rotating element, the shovellike part being able to touch said surfaces such that everytime said frame move across said surfaces, the rotating element in the frame lifts objects, which are near said shovellike part, up through the frame and gravitationally dump said objects, through the spaces between said members on said rotating element, into said receptacle, the spaces between said members on said rotating element being large enough to allow said objects to fall through them.

2. The invention in claim 1 whereby, the means to move the frame across surfaces is the same as the means to drive the rotating element.

3. The invention in claim 1 whereby, the rotating element is a disc with a plurality of blades, said blades placed around the disc edge.

4. The invention in claim 3 whereby, the receptacle is a cylinder having an opening in its lateral side.

5. The invention in claim 4 whereby, the cylinder passes through the inward periphery of the blades, said blades situated over the opening in said cylinder.

6. The invention in claim 5 whereby, the blades each have a part made of a spongy, slightly bristly material such as polyurethane foam.

7. The invention in claim 6 whereby, the means to move the frame across surfaces is the same as the means to drive the rotating element.

8. The invention in claim 7 whereby, the means to drive the rotating element is a wheel.

9. The invention in claim 8 whereby, the means to enable the wheel to drive the rotating element is a mechanism for allowing movement in one direction and preventing movement in the opposite direction.

10. The invention in claim 9 whereby the mechanism is one comprised of a structure, a spinning member within said structure, an elastic element within said structure, and a boss, said structure being such so as to enable said spinning member to move a distance freely in a certain direction from a certain point within said structure, said spinning member actually doing such when said boss collides with said spinning member while said boss is moving in the direction that said spinning member is able to move freely in, and said spinning member, via means of said elastic element, is such that it returns to said point within said structure when said boss fails to make contact with said spinning member while said boss is moving in said direction that said spinning member is able to move freely in, also after said spinning member has returned to said point within said structure, said structure is such that is stops said spinning member from moving any further pass said point in a direction opposite to the direction that said spinning member is able to move freely in, and said boss is such that whenever it moves in said opposite direction, it collides with and adjoins with said spinning member, enabling both said boss and the structure to move with one another.

11. The invention in claim 10 whereby, a blade with straws is added to the rotating element with means provided to enable said blade to push objects in its path.

12. The invention in claim 11 whereby, the means to enable wheel to drive the rotating element is the same as the means to enable said blade to push objects in its path.

13. The invention in claim 9 whereby, a blade with straws is added to the rotating element with means provided to enable said blade to push objects in its path.

14. The invention in claim 13 whereby, the means to enable wheel to drive rotating element is the same as the means to enable said blade to push objects in its path.

15. The invention in claim 1 whereby, the shovellike part of said frame is a detachable piece that is able to be attached to the frame.

* * * * *